United States Patent [19]

von Hackewitz

[11] Patent Number: 5,029,857

[45] Date of Patent: Jul. 9, 1991

[54] FRAME WITH ADJUSTABLE STRING TENSIONING MEANS

[76] Inventor: Friedrich-Wilhelm von Hackewitz, 8720 Schweinfurt, Lauerweg 2, Fed. Rep. of Germany

[21] Appl. No.: 508,284

[22] Filed: Apr. 10, 1990

Related U.S. Application Data

[63] Continuation-in-part of Ser. No. 342,227, Apr. 24, 1989.

[30] Foreign Application Priority Data

Jun. 1, 1989 [DE] Fed. Rep. of Germany ..... 3917868

[51] Int. Cl.[5] ..... A63B 51/12

[52] U.S. Cl. ..... 273/73 E; 273/73 B; 273/73 C; 273/73 G

[58] Field of Search ..... 273/73 B, 73 C, 73 E, 273/73 G

[56] References Cited

U.S. PATENT DOCUMENTS

| | | | |
|---|---|---|---|
| 1,862,581 | 6/1932 | Robinson | 273/73 E |
| 2,206,548 | 7/1940 | Goeske | 273/73 E |
| 3,904,202 | 9/1975 | DeLorean | 273/73 E |
| 4,099,717 | 7/1978 | Sacks | 273/73 E |
| 4,102,533 | 7/1978 | Ida | 273/73 E |

FOREIGN PATENT DOCUMENTS

| | | | |
|---|---|---|---|
| 151916 | 6/1953 | Austria | 273/736 |
| 3343300 | 11/1983 | Fed. Rep. of Germany | 273/73 E |

*Primary Examiner*—Edward M. Coven
*Assistant Examiner*—Raleigh W. Chiu
*Attorney, Agent, or Firm*—Rosen, Dainow & Jacobs

[57] ABSTRACT

A tennis racket frame (1) strung with strings (2) under tension has two ends (4, 5) neighboring each other, joined in each instance by a flexible brace (6, 7) to a holding member (3), which ends can be spread apart or drawn together by tensioning means (22, 25, 26) so that the magnitude of the tension can be adjusted. So that relatively high spreading or drawing forces can be applied, the frame (1) has at least one shackle (8) joining the two ends (4, 5) of the frame to each other. Each shackle (8) has two legs in a V-shaped arrangement, joined together angularly movable at their one end and force-locked at their other end to the corresponding end of the frame (1). An adjusting element (22, 25, 26) acts on the shackle ends joined together transversely to the frame (1), so that their included angle is variable on the principle of a toggle.

12 Claims, 4 Drawing Sheets

FIG. 2
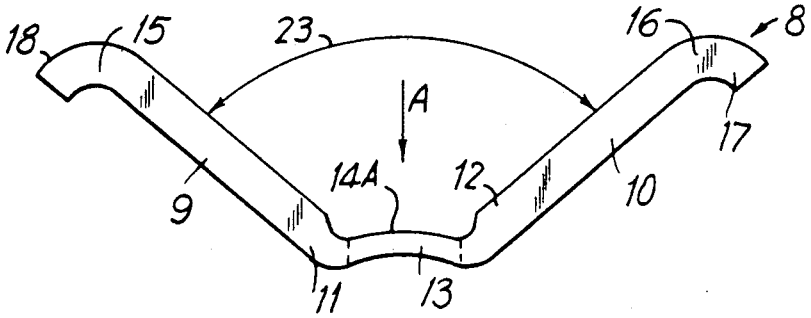
FIG. 3
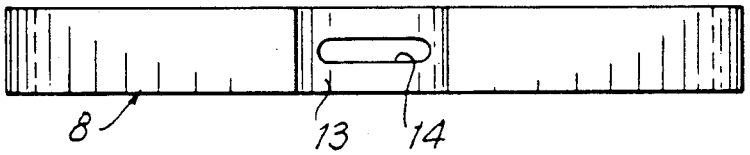
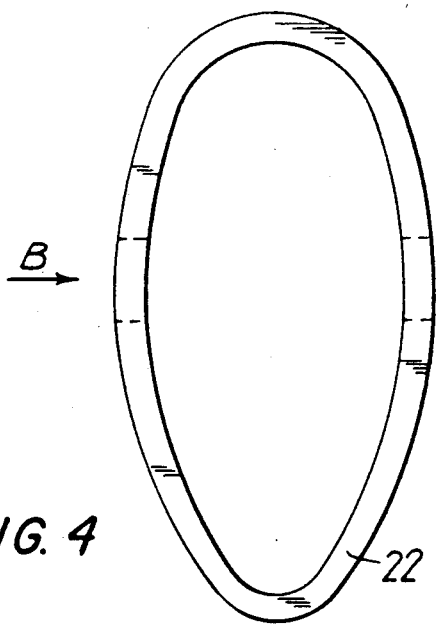
FIG. 4
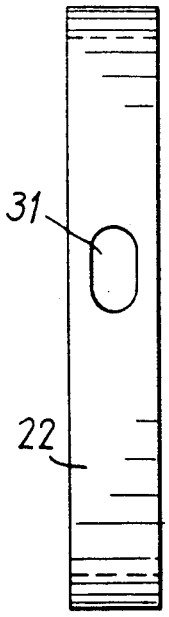
FIG. 5

FRAME WITH ADJUSTABLE STRING TENSIONING MEANS

RELATED APPLICATION

This application is a continuation-in-part of a copending U.S. patent application, Ser. No. 342,227, filed Apr. 24, 1989.

BACKGROUND OF INVENTION

The present invention relates to a frame strung with strings or the like under tension, and in particular to a game or tennis racket frame with adjustable string tensioning means.

A frame of the stated kind has been proposed in which the adjusting elements spread or draw the two ends of the frame more or less away from each other or towards each other. See, for example, German Patent Application P 38 13,872.7, which corresponds to the related U.S. patent application, whose contents are incorporated herein by reference. However, accommodation of a suitable adjusting element between the braces at the racket throat to apply sufficiently great spreading or drawing forces may present difficulties for the proposed frame.

SUMMARY OF INVENTION

The principal object of the invention is a game racket having adjustable string tensioning means that can readily be accommodated and is simple to install at the racket throat, yet be capable of exerting extremely strong spreading or drawing forces on the two ends of the frame.

In accordance with one aspect of the invention, a shackle member or intermediate connecting part having two legs is mounted in the racket throat so as to engage the two frame ends. The shackle legs which are movable form a generally V-shaped configuration to define an included angle between the two legs of the shackle where they join one another. The adjusting element is mounted to engage the shackle member and vary the included angle. Since the two legs of the shackle act on the toggle principle, i.e., as a crosspiece to hold the adjusting element and assist in tightening, comparatively small adjusting forces suffice for each adjusting element. The dimensions of the adjusting elements may be kept small, so that they are simple to install between the frame braces. At the same time, extremely high spreading or drawing forces can be exerted on the ends of the frame.

In a refinement of the invention according to another aspect of the invention, the adjusting elements comprise a ring of simple manufacture which is installed between the braces of the frame. The ring may be slit in one place on its periphery or else closed over its periphery. This ring bears against one end surface of the rigid handle or holding member in one location on its periphery and presses a diametrically opposed place in its periphery against the angularly movable, mutually joined ends of the two legs of the shackle. The adjusting elements preferably comprise adjusting screws or the like, acting upon the elastically and/or plastically flexible ring transverse to its adjusting forces to diametrically narrow or widen it, so that the ring will exert adjusting and tensioning forces between the two locations on its periphery as required to adjust the stringing tension.

In an additional preferred refinement, the ring is forcelocked to the two braces of the frame so that it will retain its prescribed location along the plane of the frame.

Another refinement according to the invention provides a ring that is elastically or plastically deformable essentially only along the plane of the frame. In this way, the throat of the frame of a tennis racquet is reinforced by the ring, so that the frame can withstand higher impact and concussion loads.

In accordance with another feature of the invention, the adjusting elements act on paired shackles in a V-shaped arrangement and can in addition cooperate with other adjusting elements. In each instance, two spreading or drawing shackles based on the toggle principle are present on the frame, so that the application of high spreading and drawing forces between the two ends of the frame is further improved.

SUMMARY OF DRAWINGS

The frame according to the invention will be further illustrated by two embodiments represented in the drawings by way of example. In the drawings:

FIG. 2 shows a side view of the shackle of the frame represented in FIG. 1, FIG. 3 shows a top view of the shackle in the direction of the arrow A in FIG. 2, FIG. 4 shows a side view of the ring of the frame represented in FIG. 1, FIG. 5 shows a top view of the ring in the direction of the arrow B in FIG. 4.

DETAILED DESCRIPTION OF PREFERRED EMBODIMENTS

Figure 1:
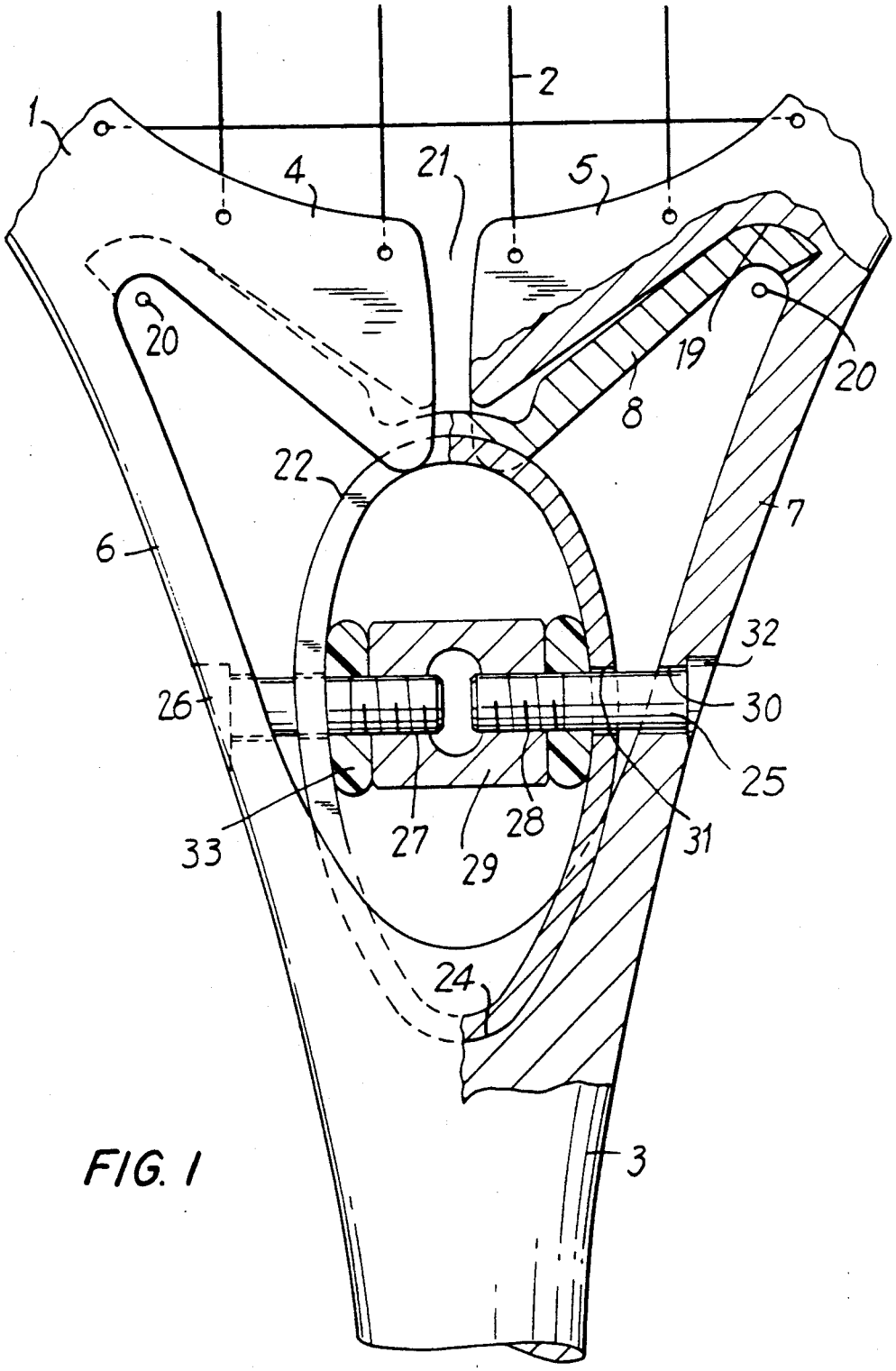
FIG. 1 shows a plan view, partly in section, of the throat region of a frame of a tennis racquet in accordance with the invention.

In FIG. 1, 1 designates the frame of a tennis racquet, arranged to lie in a plane. Only the bottom part of the frame is shown, at the vicinity of the throat. The frame upper part, not shown, is in the usual conventional oval shape with vertical and horizontal stringing as is well known. In a known manner, this frame 1 is made deformable by plastic and/or plastic bending substantially only within its plane, and may be made of wood, metal or plastic. Within it, the frame 1 is strung with gut or plastic strings 2 under tension, which also extend along its plane.

At a throat or junction on its periphery, the frame 1 is fixedly joined to a rigid holding member 3 serving as a handle. At this junction, tensioning means are arranged, whereby the magnitude of the tension in the strings 2 can be varied and adjusted.

The frame 1 has at its junction two ends 4, 5 arranged at a short distance from each other and each fixedly joined in one piece to the holding member 3 by way of braces 6, 7 respectively. The two braces 6, 7 and the holding member 3 extend along the plane of the frame 1. These braces 6, 7 are of such configuration that they can flex elastically along the plane of the frame only.

The two ends 4, 5 of the frame 1 are bridged by a shackle or connecting member 8 of spring steel, comprising two legs 9, 10 meeting V-shaped at an obtuse angle 23 in the plane of the frame 1 (FIGS. 2 and 3). The two legs 9, 10 are joined together angularly movable at their one end 11, 12 by way of a thin-walled flexible connecting portion 13, having a through slot 14 transverse to the plane of the frame. The thinned wall 13 with or without the slot 14 contribute to providing flexibility at the shackle leg joint.

The connecting portion 13 also comprises an indentation 14A in the two legs 9, 10, made adjacent to the one end 11, 12 in the shackle 8. The indentation 14A extends through perpendicular to the plane of the frame 1, so that the cross-section of the legs 9, 10 where they meet the connecting portion 13 is reduced.

The other end 15, 16 of each of the two legs 9, 10 has an incurved or bent portion 17 with an outer surface 18 having the shape of a cylindrical segment. Each outer surface 18 (FIG. 1) rests slidingly on a matching supporting wall 19 also having the shape of a cylindrical segment, in a concavity of the respective end 4, 5, so as to form an articulation whose pivot 20 is perpendicular to the plane of the frame 1.

By way of this articulation, the other ends 15, 16 of the legs 9, 10 are thus force-locked to the respective end 4, 5 of the frame 1, and between the two ends 4 and 5, a place is created that will yield only in the direction of the periphery of the frame 1.

The two ends 4 and 5 form a non-through partial slot 21, open towards the strings 2 and closed towards the holding member 3.

At its junction, the frame 1 has tensioning means to adjust the magnitude of the tension in the strings 2.

In the present instance, these tensioning means comprise a ring 22 of spring steel, acting on the ends 4, 5 joined to each other of the legs 9, 10 in a direction in the plane of the frame transverse to the frame 1, so that the angle 23 of the legs 9, 10 is variable on the principle of a toggle.

The ring 22 is arranged to lie in the plane of the frame 1. It has a rectangular cross section whose sides transverse to the plane of the frame 1 are substantially longer than its sides parallel to the plane (FIGS. 4 and 5). In this way, the ring 22 is made elastically deformable in bending along the plane of the frame 1 only.

The ring 22 is installed between the two braces 6 and 7. On its periphery away from the strings 2, its lower end in FIG. 1, the ring 22 is supported and laterally secured on an end surface 24 of a concavity in the holding member 3 facing the frame 1. Its upper end engages the shackle middle portion 13.

Transverse to each brace 6, 7 extends adjusting screws 25, 26. The two adjusting screws 25 and 26 are arranged coaxial to each other. A common nut 29, force-locked with a threaded segment 27, 28 respectively of the facing ends of the two adjusting screws 25 and 26 joins the two adjusting screws 25, 26 to each other. The centerlines of the two adjusting screws 25 and 26 lie approximately in the plane of the frame 1. The threaded portion 27 of the screw 26 has a right-hand thread and the threaded portion 28 of the screw 25 has a left-hand thread of the same pitch.

Each adjusting screw 25, 26 passes through a hole 30 in a brace 6, 7 and through a hole 31 in the ring 22 and has a head portion 32 resting against the corresponding brace 6, 7 from the outside.

Between the two faces of the nut 29 and the opposed brace 6, 7, a vibration-damping disk 33 of compressible plastic is interposed. Each disk 33 secures the adjusted rotary position of the nut 29 on the ring 22 in a geometrically and frictionally positive manner.

By rotating the nut 29 as a turnbuckle, the ring 22 is made to be compressed by the adjusting screws 25, 26, and this together with the two braces 6, 7, which are pressed mutually towards each other in their middle. The ring 22 acts against the toggle force of the ends 11, 12 of the legs 9, 10 so that the two ends 4 and 5 of the frame 1 are spread apart. This slightly enlarges the acute angle 23 between the legs 9 and 10. In this way a somewhat higher tension is adjusted in the strings 2. In other words, compressing the ring 22 horizontally, elongates it vertically, urging the connecting portion 13 which it engages upward causing the two frame ends 4, 5 to slightly spread apart thereby increasing the string tension. The reverse action will loosen the strings. As will be observed, the ring 22 fits neatly within the open throat between the curved section at the bottom where the braces 6, 7 join the handle and the slot 14 at the connecting portion 13 of the shackle member 8. The screws 25, 26 under the tension provided by the nut 29 remain solidly connected to the braces 6, 7. Yet ready access by the user to the nut 29 is provided allowing the user to vary stringing tension by rotation of the nut 29.

Figure 6:
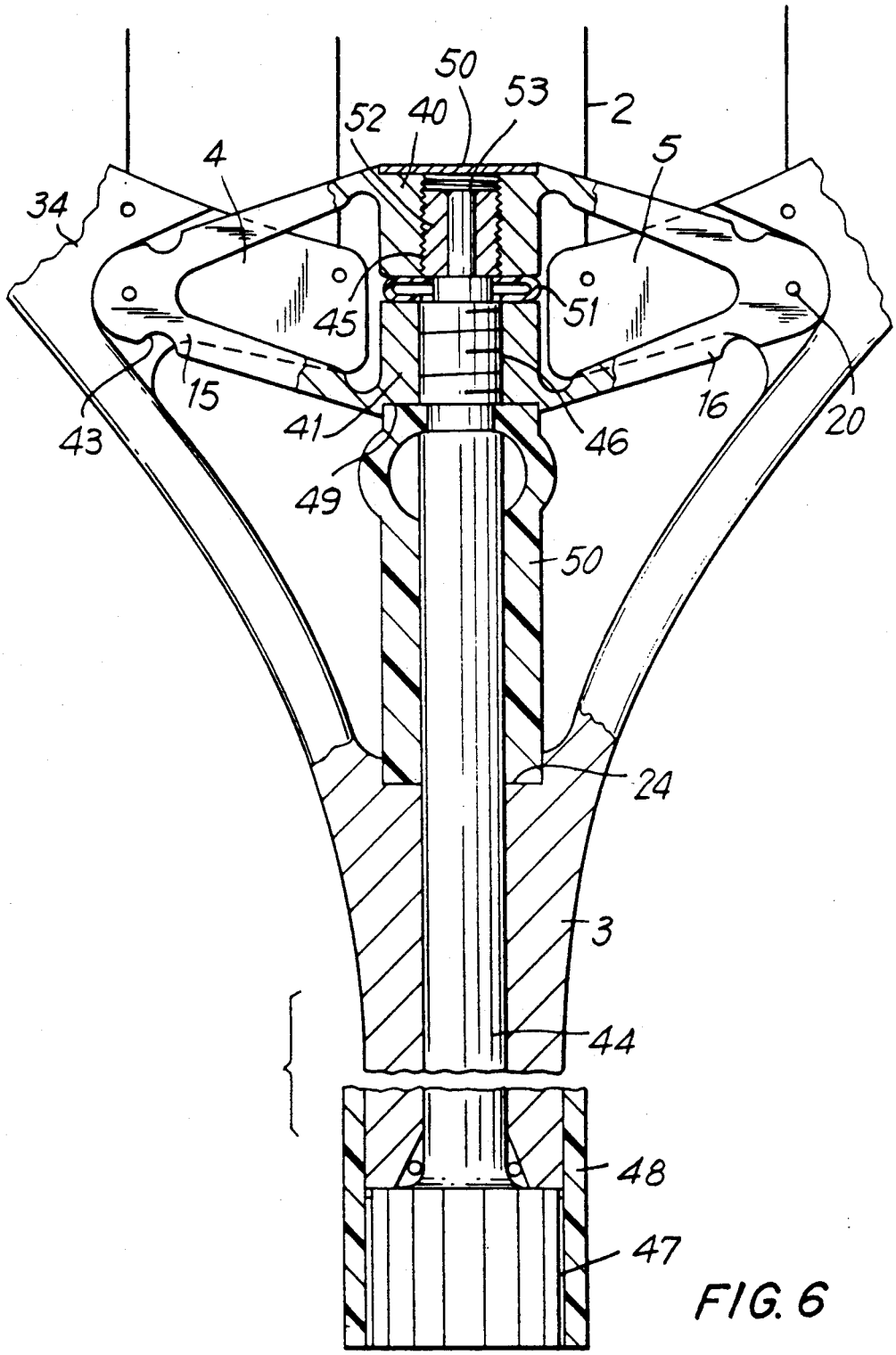
FIG. 6 shows a plan view similar to FIG. 1 of a modified frame of a tennis racquet in accordance with the invention, using two shackles arranged in pairs.
Figure 7:
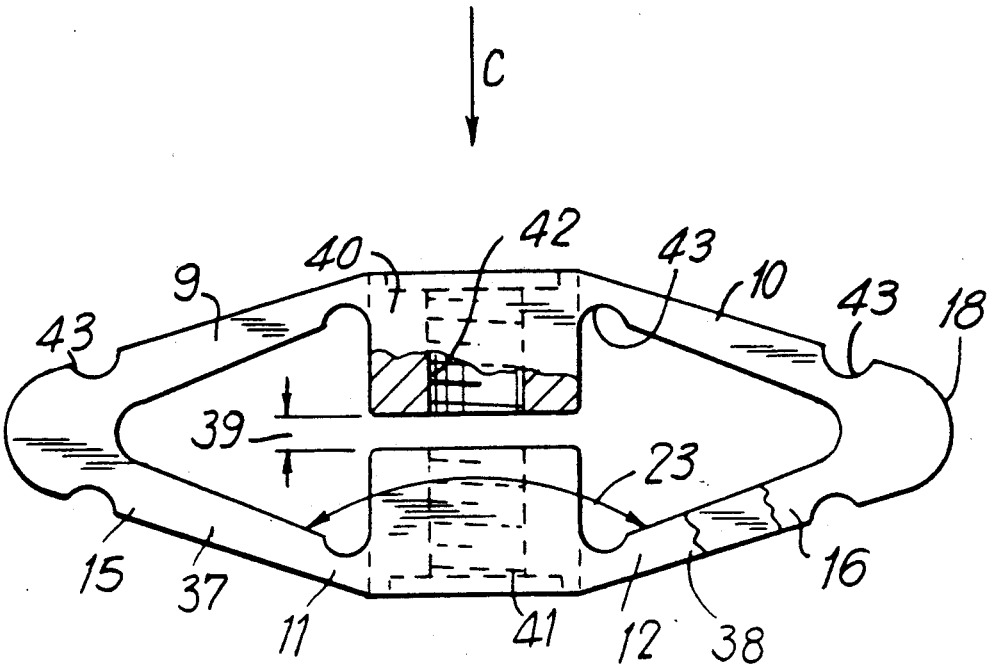
FIG. 7 shows a side view of the shackles of the frame represented in FIG. 6, joined to each other.
Figure 8:
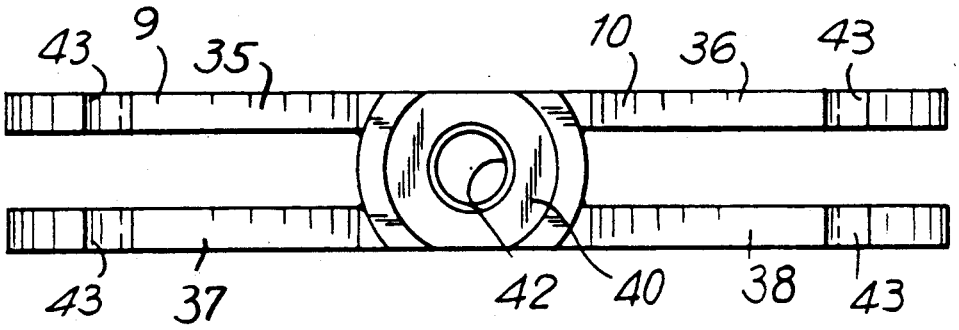
FIG. 8 shows a top view in the shackles in the direction of the arrow C in FIG. 7.

FIG. 6 shows a modified frame 34 of a tennis racquet. Between the two ends 4 and 5 of this frame 34, two pairs of shackles 35, 36, 37 and 38 deformable in the circumferential direction of the frame 34 are force-locked in between (FIGS. 7 and 8).

In each pair of shackles 35, 36 and 37, 38, the one ends 11, 12 of the two legs 9, 10 are joined together in each instance by a connecting portion 40, 41. The two connecting portions 40 and 41 are at a distance 39 from each other, variable with the aid of an adjusting element. They have a threaded through hole 42 whose centerlines, located in the plane of the frame 34, are in line with each other and extend transverse to the frame 34.

The two shackles 35 and 36 and the two shackles 37 and 38 are so arranged that their legs 9, 10 meet each other in a V shape, a so-called "0" arrangement.

In the present case, the one ends 11, 12 and the other ends 15, 16 of the shackles 35, 36, 37 and 38 have an indentation 43 extending throughout its width perpendicular to the plane of the frame 34, reducing thereat the cross section of the shackles 35, 36, 37 and 38. In the places of the indentations 43, in other words, the shackle 35, 36, 37, 38 in question is flexible. The bending of the shackles 35, 36, 37 and 38 at the indentations 43 takes place about an axis of flexure 20 perpendicular to the plane of the frame 34 (FIGS. 7 and 8).

At their other ends 15, 16, both the two shackles 35 and 37 and the two shackles 36 and 38 are joined together in one piece and supported similarly to FIG. 1 by way of an outer surface 18 in the shape of a cylindrical segment on a matching wall 19 in the shape of a cylindrical segment on the respective end 4, 5 of the frame 34, in the direction of the periphery of the frame 34.

The adjusting element in this case comprises a spindle 44 having a threaded portion 45 with a right-hand thread and a threaded portion 46 with a left-hand thread.

The threaded portion 45 of the spindle 44 engages the upper threaded hole 42 in the connecting portion 40, and its threaded portion 46 engages the lower threaded hole 42 in the connecting portion 41, with force-locking.

The rotary position of the spindle 44 is adjustable by a user and fixable by means of a grip sleeve 48, alternatively a tension sleeve or the like to be slipped axially over the holding member 3, applying tension radially inward and acting on the reeded periphery 47 of the spindle 44. The grip sleeve 48 may be fixedly attached to the holding member 3 in a known manner.

Between an end surface 24 of the holding member 3 at its throat facing the frame 34 and an end surface 49 of the connecting portion 41 facing away from the frame 34, a sealing sleeve 50 is forced in under precompression against the frame 34, sealing the spindle 44 from the outside and retaining a lubricant, for example grease, in the region of the threaded holes 42 in the two connecting portions 40 and 41.

Similarly, an elastically yielding sealing sleeve 51 is slipped onto the spindle 44 between the two connecting portions 40 and 41.

At the upper end of the threaded hole 42 in the connecting portion 40 towards the strings 2, a cover plate 54 is fixed, closing the hole 42 tightly from the outside.

Besides, the threaded portion 45 comprises the periphery of threaded bushing 52 fixed by welds 53 on a nipple of the spindle 44.

By rotating the spindle 44 on its axis, vertical in FIG. 6, the two connecting portions 40 and 41 are mutually shifted in the direction of said axis, so that their spacing 39 varies. The two legs 9, 10, of the shackles 35, 36, 37 and 38 are thereby shifted with respect to their included angle 23 on the toggle principle, and the desired tension in the strings 2 is set.

As will be observed from FIG. 8, the shackle legs are spaced apart and the space between is made just wide enough to accommodate the frame ends 4, 5, which are thus bracketed by the shackle.

The embodiments of the invention described above by way of example are susceptible of modifications in design, for example, the leg of one or more pairs of shackles may alternatively be arranged to meet each other in a V-shaped arrangement, thus creating a so-called "X" arrangement of the legs.

If an originally excessive tension in the strings is to be reduced, tensile forces must be applied by the shackles to the two ends of the frame, drawing the latter together. In that case, the other ends of the shackles are best joined to the respective end of the frame by a fixed joint (pivot) whose axis is perpendicular to the plane of the frame. The adjusting forces of the adjusting element or elements then act by tending to reduce the obtuse angle between the two legs of each shackle.

While the invention is primarily applicable to tennis rackets, it can also be used with other strung game rackets.

While the invention has been described and illustrated in connection with preferred embodiments, many variations and modifications as will be evident to those skilled in this art may be made therein without departing from the spirit of the invention, and the invention as set forth in the appended claims is thus not to be limited to the precise details of construction set forth above as such variations and modifications are intended to be included within the scope of the appended claims.

I claim:

1. In a tennis racket frame arranged in a plane and deformable within the plane by bending and strung on its interior with strings under tension and fixedly joined to a rigid handle, said frame having at its junction with the handle two ends movable relative to each other in the circumferential direction of the frame and arranged at a short distance from each other, each of which ends is fixedly joined to the handle by a brace deformable in the plane of the frame by bending, tensioning means being arranged at the junction to adjust the magnitude of the tension in the strings, the tensioning means comprising at least one adjusting element pushing or pulling the two ends towards or away from each other, the improvement comprising at least one shackle member deformable in the circumferential direction of the frame, said shackle comprising two legs meeting in V-shaped relation to each other at an included obtuse angle in the plane of the frame, said two legs where joined at one of their ends being angularly movable relative to each other and forcelocked at their other end to a respective end of the frame, the adjusting element engaging and acting upon the said one ends joined to each other in a direction generally transverse to the frame ends such that the two legs of the shackle can be deformed thereby varying their included angle on the principle of a toggle and thereby vary the stringing tension.

2. A frame according to claim 1, wherein the handle has an end surface facing the frame, the adjusting element comprises a ring lying in the plane of the frame, bendable deformable in that plane, installed between the two braces, and resting on said end surface of the handle, and means for narrowing the ring transverse to the braces and correspondingly enlarging its dimension where it engages the shackle, said means comprising at least one adjusting screw.

3. A frame according to claim 2, wherein two adjusting screws are provided and arranged to act upon the two braces from the outside and pull them towards each other against the ring.

4. A frame according to claim 2, wherein the ring has a rectangular cross section whose sides extending transverse to the plane of the frame are substantially longer than its sides extending parallel to the plane.

5. A frame according to claim 1, further comprising two shackles joining the two ends of the frame.

6. A frame according to claim 5, wherein each shackle comprises two legs joined at one of their ends, the said one ends of the two shackles being joined together by way of a connecting portion, the connecting portion having a first threaded hole with a right-hand thread and a second threaded hole aligned with the first with a left-hand thread, said adjusting element comprising a spindle having a matching threaded portion in force-locked engagement with the two threaded holes and mounted so as to adjustable in its rotary position.

7. A frame according to claim 6, wherein the rotary position of the spindle is adjustable by means of a member fixedly joinable to the handle and acting upon the periphery of the spindle.

8. A frame according to claim 1, wherein the shackle portion adjacent to where its legs join has an indentation extending throughout perpendicular to the plane of the frame and reducing the cross section of the respective leg.

9. A frame according to claim 1, wherein the other ends of the legs of the shackle ar joined by a force-locking articulation whose pivot is perpendicular to the plane of the frame to the respective end of the frame.

10. A frame according to claim 1, wherein the frame ends are spaced apart to form a gap, and the shackle member bridges the gap.

11. A frame according to claim 10, wherein the said other ends of the shackle legs have a curved outer surface seating in a correspondingly curved concavity in the frame at the region where the braces join the frame.

12. A frame according to claim 11, wherein the curved surface is cylindrical.

* * * * *